United States Patent [19]

Gorin

[11] 4,138,221

[45] Feb. 6, 1979

[54] MANUFACTURE OF PELLETS FROM COAL CONVERSION PRODUCTS

[75] Inventor: Everett Gorin, San Rafael, Calif.

[73] Assignee: Continental Oil Company, Stamford, Conn.

[21] Appl. No.: 861,079

[22] Filed: Dec. 15, 1977

[51] Int. Cl.[2] ..... C10L 5/00; C10L 5/16; C10G 1/00

[52] U.S. Cl. ..... 44/10 C; 44/23; 44/24; 201/5; 208/8

[58] Field of Search ..... 44/1 F, 10 C, 10 R, 44/23, 24; 201/5, 6; 208/8

[56] References Cited

U.S. PATENT DOCUMENTS

| | | | |
|---|---|---|---|
| 1,793,014 | 2/1931 | Rodgers | 44/10 C |
| 2,734,690 | 2/1956 | Mattox et al. | 44/23 X |
| 3,562,783 | 2/1971 | Gorin | 208/8 X |
| 3,748,254 | 7/1973 | Gorin | 208/8 |
| 3,920,418 | 11/1975 | Rice | 208/8 X |
| 4,008,054 | 2/1977 | Clancey et al. | 44/10 R |
| 4,030,982 | 6/1977 | Gorin et al. | 201/6 |

*Primary Examiner*—Carl Dees

*Attorney, Agent, or Firm*—D. Leigh Fowler; F. Lindsey Scott; William A. Mikesell

[57] ABSTRACT

The manufacture of pellets from pumpable non-distillable coal conversion products is accomplished as follows. The non-distillable product is split into two streams. A pelletizable composition is made from a mixture of one stream with char made from the other stream. The pelletizable composition is converted to pellets in a pelletization zone supplied adiabatically with heat from the preheated char.

2 Claims, 1 Drawing Figure

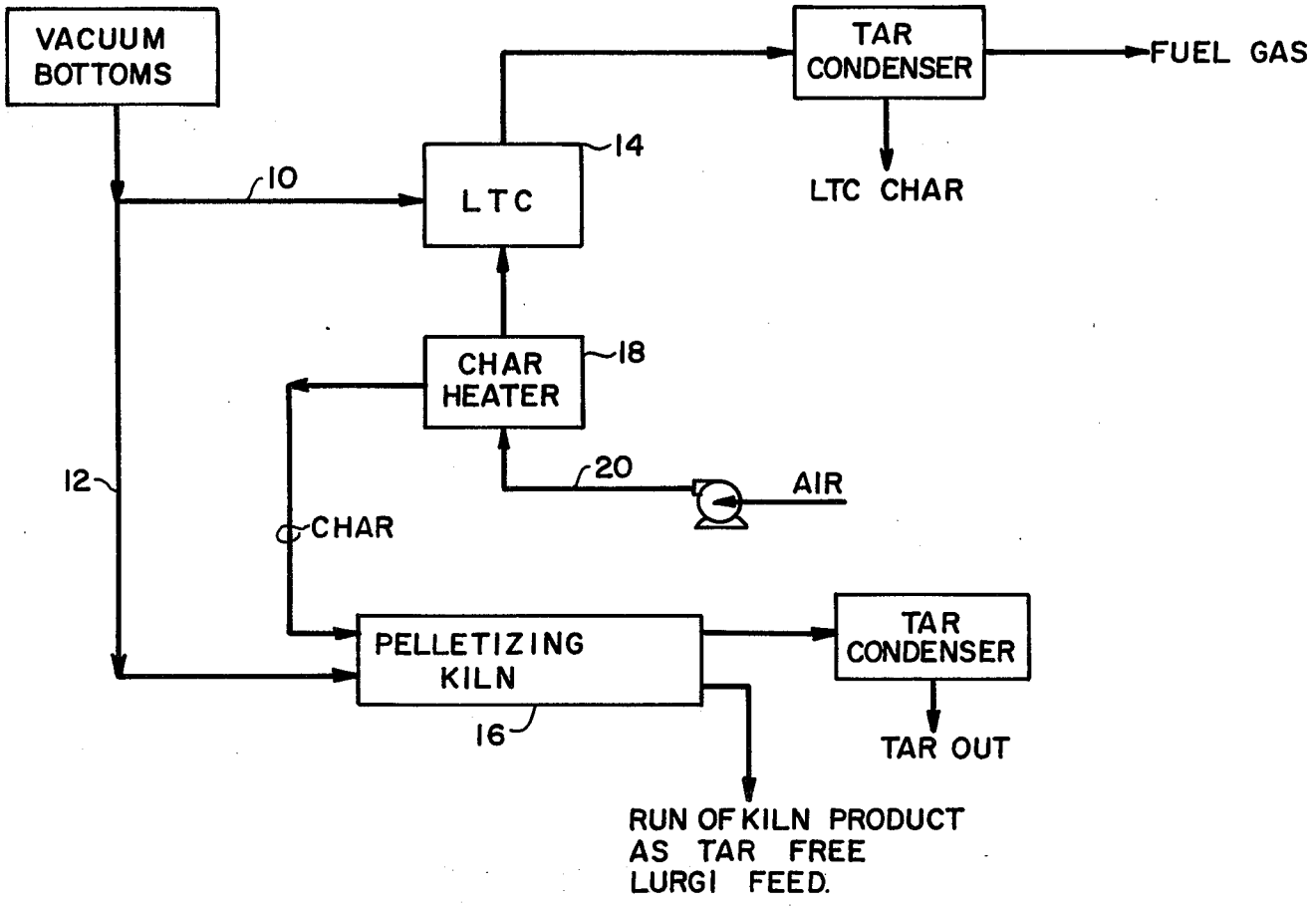
VACUUM BOTTOMS
10
12
LTC
14
CHAR HEATER
18
20
AIR
CHAR
PELLETIZING KILN
16
TAR CONDENSER
TAR OUT
RUN OF KILN PRODUCT AS TAR FREE LURGI FEED.
TAR CONDENSER
LTC CHAR
FUEL GAS

MANUFACTURE OF PELLETS FROM COAL CONVERSION PRODUCTS

This invention relates to an improvement in coal conversion processes and, more particularly, to the pelletization of any pumpable non-distillable portion of the products obtained in such processes.

Coal conversion processes include coal carbonization at low, medium and high temperatures; coal gasification; coal liquefaction, and so on, to produce widely varying amounts and kinds of liquids, gases, and solids, depending on the conditions and reactants employed. Generally, in all such processes, a liquid pyrolysis product is obtained which is non-distillable (without coking) and which also, but not necessarily, contains ash and carbonaceous solids. Such liquids, by themselves, are difficult to handle, are hydrogen deficient, and if ash is present, are of particularly low Btu content.

Pelletization of the products such as those described above has been described in numerous patents of the assignee of the present invention. They include the following U.S. Pat. Nos.: 3,562,783; 3,748,254; 4,008,054; and 4,030,982. The preferred system set forth in these patents for making the pellets involves the use of a rotary kiln which is adapted to rotate about its slightly inclined horizontal axis. The kiln serves to tumble hot recycle char (char is devolatilized carbonaceous solids) and the pumpable non-distillable product together as they advance through the kiln. The temperature of the char as introduced into the kiln is selected so as to maintain the temperature of the tumbling mixture adiabatically above 200° C., or above 350° C. if carbonizing conditions are desired. The size of the resulting pellets is determined primarily by the ratio of liquids to solids in the kiln. In general, in order to attain the desired pelletizing conditions in the kiln, particularly temperature and liquid-to-solid ratio, prohibitive amounts of hot char are required, resulting in uneconomically sized plants. The primary object of this invention is to significantly reduce the char requirements, and thus, the size of the pelletizing plant.

SUMMARY OF THE INVENTION

In accordance with my invention, the pumpable non-distillable product is split into two streams. The first stream is used to produce substantially all the char required in the pelletization zone, while the second stream is fed directly to the pelletization zone. The production of the char may be by any convenient method of low temperature carbonization, including fluid coking. The heat is supplied adiabatically to the pelletization zone by the char which is appropriately preheated. The ratio of liquids to solids in the pelletization zone is correlated in a known manner with the conditions maintained in the pelletization zone to produce a minimum of undersize product, so that the major portion of the product pellets may be used as feed to a fixed or gravitating bed gasifier.

For a better understanding of my invention, its objects, and advantages, reference should be had to the following description of the preferred embodiment of the present invention and to the accompanying drawing which illustrates schematically the preferred embodiment.

PREFERRED EMBODIMENT

In the preferred embodiment of the present invention, the feedstock to my improved process is obtained from those coal liquefaction processes (now well-known) wherein a liquefaction solvent is present during the liquefaction of the coal. Liquefaction may be achieved by hydrogenation, depolymerization, extraction, etc. The liquefaction solvent, which is generally coal derived, may function as solvent for the coal or for the products, or both. It may also play a reactive role, for instance, in the depolymerization and hydrogenation of the coal molecules. Liquefaction may also be achieved with or without the presence of a catalyst, and with or without the presence of molecular (gaseous) hydrogen, in addition to the liquefaction solvent. Such liquefaction processes may be used to make liquid and gaseous fuels, as well as low sulfur and non-caking feedstocks for fixed bed gasifiers.

The effluent slurry product of a coal liquefaction process such as has just been described contains extract which comprises both distillable and non-distillable fractions; a distillable but generally high boiling liquefaction solvent; and undissolved ash-containing carbonaceous solids, a substantial portion of which is suspended in the solution because of their micron and submicron size. The feed to my process is one which has been obtained as the bottoms fraction resulting from the vacuum distillation of the entire effluent slurry product. The residual solids are essentially all concentrated in the bottoms fraction. If desired, further concentration may be achieved by selective solvent extraction with a distillable fractionating solvent which preferentially dissolves the lower molecular weight portion of the non-distillable residuum.

Referring now to the drawing, the feedstock consisting essentially of the vacuum bottoms described above is split into two streams, and pumped through conduits 10 and 12 to a low temperature carbonization (LTC) plant 14 and to a Pelletizing Kiln 16, respectively. The LTC plant 14 may be a conventional fluid coker which is designed to yield about 55 percent by weight of char from the vacuum bottoms feed. The Pelletizing Kiln 16 is a rotary kiln which is adiabatically heated by hot char from a char heater 18. The latter preferably houses a fluidized bed of char received from the LTC plant 14; and fluidized and heated to the required preheat temperature by combustion with air introduced through conduit 20.

The formulation in the Pelletizing Kiln 16 is maintained at about 42.5 weight percent vacuum bottoms and the balance hot char. The temperature of the preheated char is such as to maintain the formulation in the kiln at about 450–475° C., thereby producing tar-free pellets. Under these conditions, the weight percent of the vacuum bottoms fed to the kiln is about 27. Thus, the pelletizing plant size is reduced by nearly one-fourth.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. The process of pelletizing a pumpable non-distillable product derived from a coal conversion process which comprises:

(a) splitting said product into first and second streams;

(b) subjecting said first stream to low temperature carbonization to yield particulate char and vaporous products;

(c) forming a pelletizable composition out of said second stream and said particulate char;

(d) pelletizing said pelletizable composition; and (e) recovering pellets from step (d).

2. A process according to claim 1 wherein said pumpable non-distillable product in the bottoms fraction obtained by the vacuum distillation of the effluent slurry produced by the solvent extraction of coal under liquefaction conditions.

* * * * *